US011730197B2

(12) United States Patent
Aksenov et al.

(10) Patent No.: US 11,730,197 B2
(45) **Date of Patent: *Aug. 22, 2023**

(54) VAPORIZER CARTRIDGE WITH REMOVABLE RING

(71) Applicant: The Blinc Group, Inc., New York, NY (US)

(72) Inventors: Alexander Aksenov, New York, NY (US); Arnaud Dumas de Rauly, New York, NY (US)

(73) Assignee: The Blinc Group, Inc., New York, NY (US)

( * ) Notice: Subject to any disclaimer, the term of this patent is extended or adjusted under 35 U.S.C. 154(b) by 102 days.

This patent is subject to a terminal disclaimer.

(21) Appl. No.: 17/305,304

(22) Filed: Jul. 2, 2021

(65) Prior Publication Data

US 2022/0279844 A1 Sep. 8, 2022

Related U.S. Application Data

(63) Continuation of application No. 17/249,526, filed on Mar. 4, 2021, now Pat. No. 11,116,251.

(51) Int. Cl.

| | |
|---|---|
| ***A24F 13/00*** | (2006.01) |
| ***A24F 40/42*** | (2020.01) |
| ***A24F 40/70*** | (2020.01) |
| ***A24F 7/00*** | (2006.01) |
| ***A24F 40/10*** | (2020.01) |

(52) U.S. Cl.
CPC ..... *A24F 40/42* (2020.01); *A24F 7/00* (2013.01); *A24F 40/10* (2020.01); *A24F 40/70* (2020.01)

(58) Field of Classification Search
CPC ..... A24F 47/00
USPC ..... 131/328–329
See application file for complete search history.

(56) References Cited

U.S. PATENT DOCUMENTS 11,116,251 B1 * 9/2021 Aksenov ..... A24F 40/42

* cited by examiner

*Primary Examiner* — Phuong K Dinh
(74) *Attorney, Agent, or Firm* — Lerner David LLP

(57) ABSTRACT

A vaporizer cartridge configured to removably interface with one or two rings is described. The cartridge features one or two separate attachment mechanisms, each attachment mechanism interfacing with one or more decorative rings. These rings can be adorned with third-party branding materials, and the removable nature of the rings allows the vaporizer cartridges to be easily replaced with rings bearing different branding materials.

7 Claims, 6 Drawing Sheets

VAPORIZER CARTRIDGE WITH REMOVABLE RING

CLAIM OF PRIORITY

This application is a continuation of U.S. patent application Ser. No. 17/249,526, filed Mar. 4, 2021, entitled "Vaporizer Cartridge with Removable Ring", the contents of which are hereby incorporated by reference in their entirety.

NOTICE OF COPYRIGHTS AND TRADE DRESS

A portion of the disclosure of this patent document contains material which is subject to copyright or trade dress protection. This patent document may show and/or describe matter that is or may become trade dress of the owner. The copyright and trade dress owner has no objection to the facsimile reproduction by anyone of the patent disclosure, as it appears in the Patent and Trademark Office patent files or records, but otherwise reserves all copyright and trade dress rights whatsoever.

FIELD OF THE EMBODIMENTS

The present disclosure relates generally to a vaporizer cartridge with one or two removable rings. More particularly, the present disclosure relates to a vaporizer cartridge that can be equipped with one or two rings bearing some ornamentation which can be easily swapped for rings with different ornamentation.

BACKGROUND

Portable electronic vaporizers have become very popular in the United States and abroad. While many types of portable electronic vaporizers exist, ones with replaceable cartridges that come pre-filled with the liquid-to-be-vaporized command a large portion of the market share.

With the ubiquity of these replaceable vaporizer cartridges, many branding and white-labeling opportunities have appeared, as companies want to put advertising on the cartridges themselves, or want to offer cartridges as company-branded merchandise. However, the reality of this type of advertising is that large quantities of branded vaporizer cartridges must be ordered, and many of these branded vaporizer cartridges sit unused in a warehouse or desk drawer, or worse, end up unused and in a landfill.

To that end, there exists a need for vaporizer cartridges that can be adorned with ornamental information such as company branding, where the branding can be easily removed and replaced with alternative, or no, branding.

In the present disclosure, where a document, act, or item of knowledge is referred to or discussed, this reference or discussion is not an admission that the document, act, item of knowledge, or any combination thereof that was known at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed. It is contemplated that the claims may encompass one or more of the conventional technical aspects discussed herein.

SUMMARY

The present disclosure provides for a vaporizer cartridge that is equipped with a removable ring. In a highly preferred embodiment, the vaporizer cartridge in accordance with the present disclosure has a central member having a top end with a first opening, a bottom end with a second opening and a threaded section, and a flared member therebetween. The central member also preferably contains a heating element. The flared member has a top surface, a bottom surface, and a first attachment means, where the threaded section is beneath the flared member.

Preferably, the vaporizer cartridge also features a container having a flat top and a tapered bottom, the container being configured to rest on the top surface and extends towards the top end, and where the container is sized to substantially contain the heating element. In a highly preferred embodiment, the container is constructed with a translucent or otherwise "see-through" material. The container also creates a fluid-impermeable barrier with the top surface. The vaporizer cartridge in accordance with the present disclosure also features a mouthpiece disposed on the top end, the mouthpiece having a fluid passthrough which is in fluid communication with the first opening and the second opening.

The vaporizer cartridge in accordance with the present disclosure also includes a first ring sized to interface with and overlap with the flared member via the first attachment means on the bottom surface. The first ring is removably attached to the first attachment means when removable attached the first ring does not overlap with the threaded section. In various embodiments, this first ring has ornamentation printed thereon.

In some embodiments of the vaporizer cartridge in accordance with the present disclosure features a second ring sized to interface with and abut against the flat top and the mouthpiece.

Further embodiments of the vaporizer cartridge in accordance with the present disclosure exist where the only attachment means is the attachment means that the mouthpiece is equipped with, such that only one ring can be removably attached to said vaporizer cartridge.

The present disclosure also contemplates a method of removably attaching one or more rings to the vaporizer cartridge in accordance with the present disclosure. In one embodiment, this method begins by providing vaporizer cartridge in accordance with the present disclosure, as described above, as well as a first ring sized to interface with and overlap with the flared member via the first attachment means on the bottom surface. Some embodiments of the method also provide for a second ring sized to interface and abut against the flat top and the mouthpiece.

The method then proceeds to the step of removably attaching the first ring to the attachment means such that the first ring does not overlap with the threaded section when interfaced with the first attachment means.

The claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

Implementations may include one or a combination of any two or more of the aforementioned features.

These and other aspects, features, implementations, and advantages can be expressed as methods, apparatuses, systems, components, program products, business methods, and means or steps for performing functions, or some combination thereof.

Other features, aspects, implementations, and advantages will become apparent from the descriptions, the drawings, and the claims.

BRIEF DESCRIPTION OF THE PREFERRED EMBODIMENTS

In the drawings, like elements are depicted by like reference numerals. The drawings are briefly described as follows.

Figure 3A:
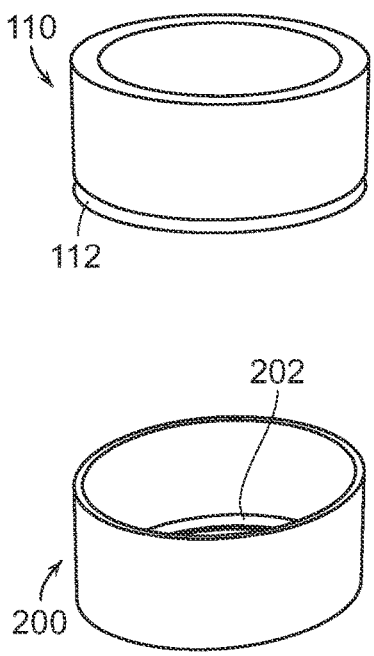
Figure 3B:
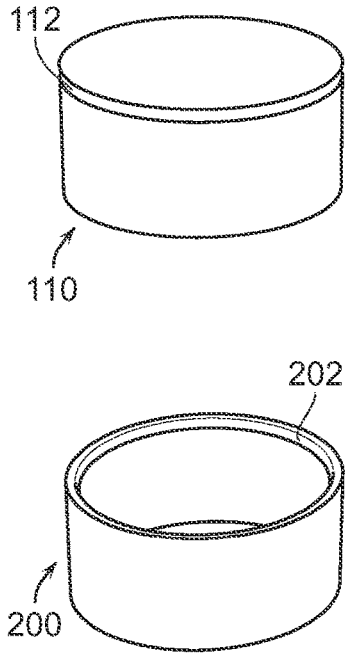
Figure 3C:
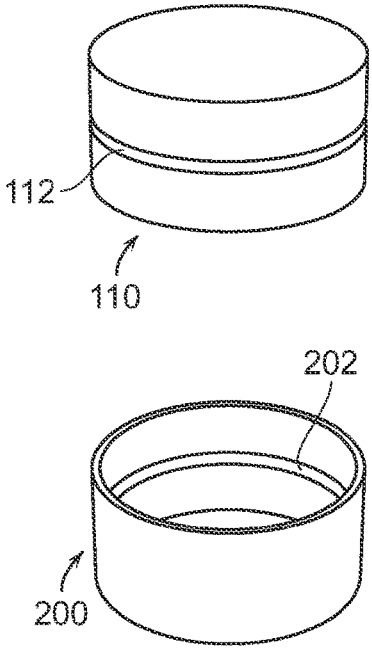
Figure 3D:
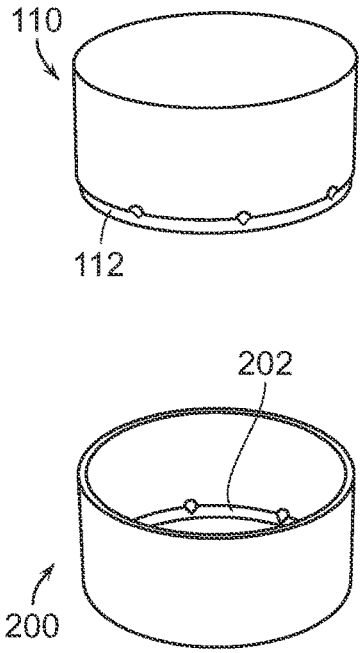
Figure 3E:
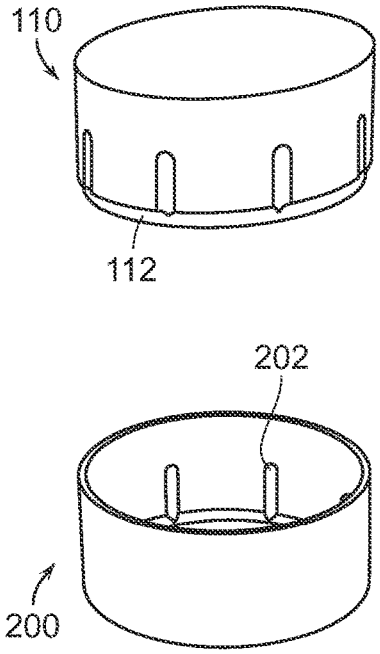
Figure 3F:
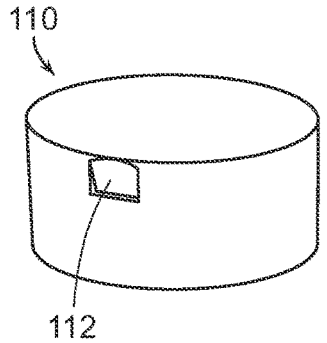
Figure 3F:
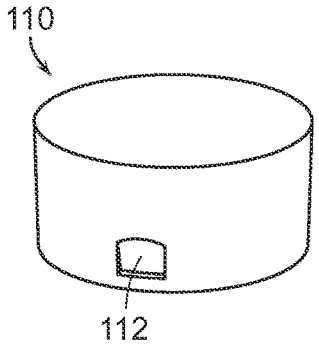
Figure 3F:
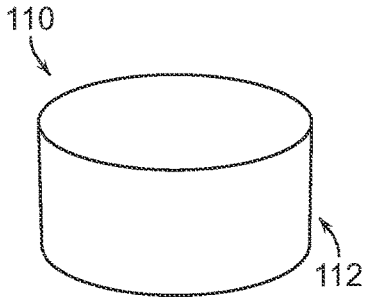
Figure 3F:
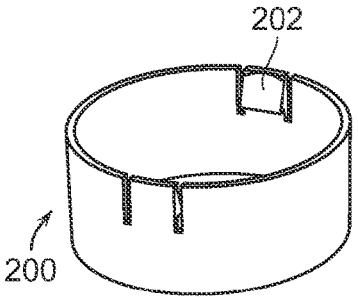
Figure 3G:
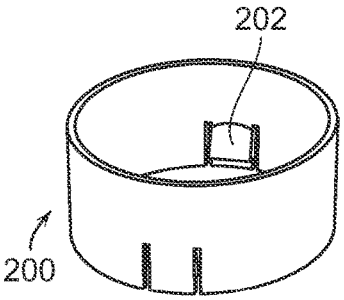
Figure 3H:
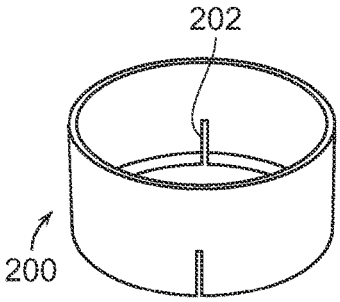
Figure 3I:
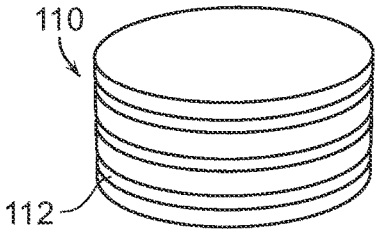
Figure 3I:
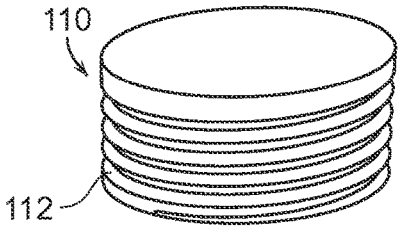
Figure 3I:
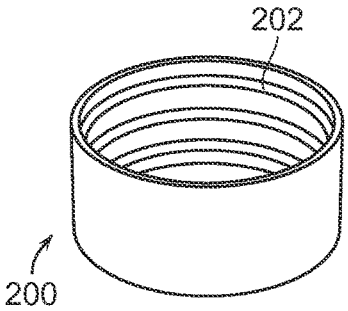
Figure 3J:
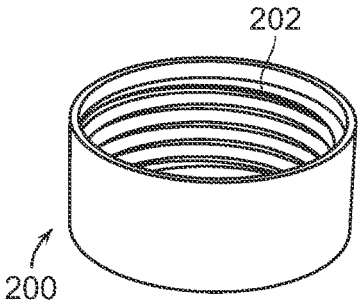
Figure 3K:
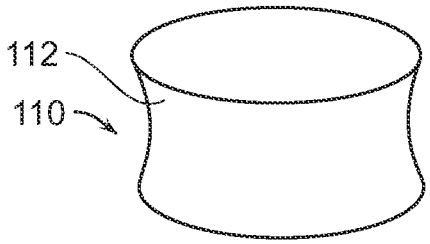
Figure 3K:
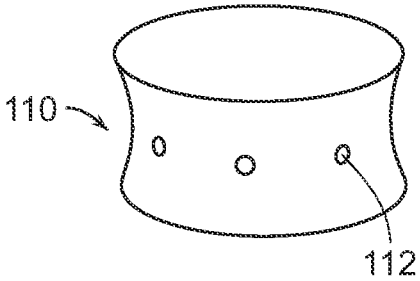
Figure 3K:
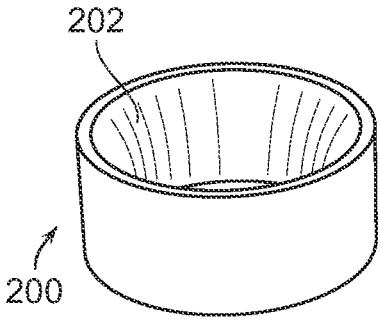
Figure 3L:
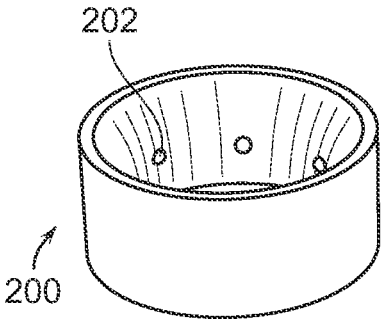
Figure 3M:
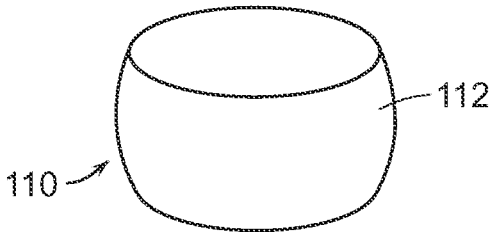
Figure 3M:
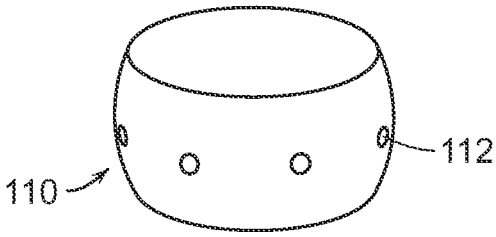
Figure 3M:
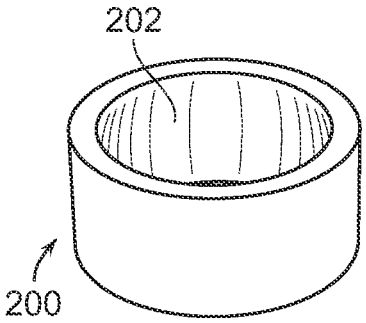
Figure 3N:
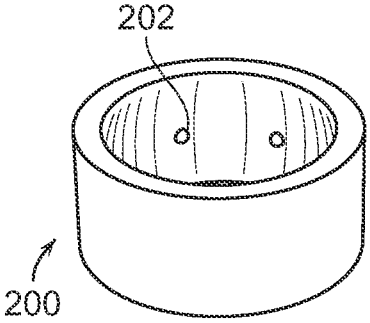
Figure 3O:
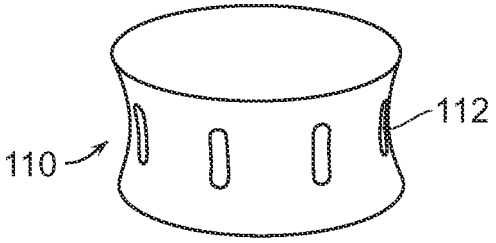
Figure 3O:
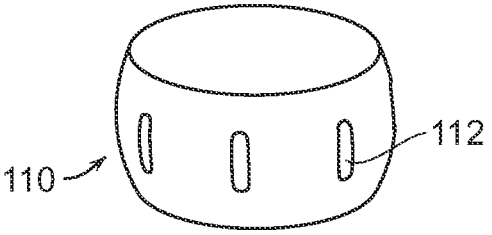
Figure 3O:
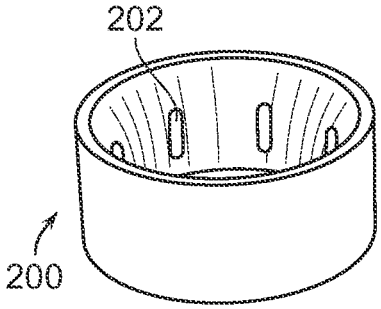
Figure 3P:
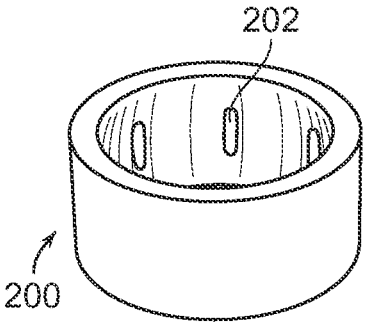
Figure 3Q:
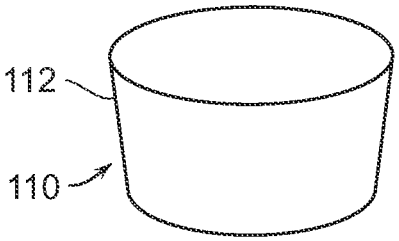
Figure 3Q:
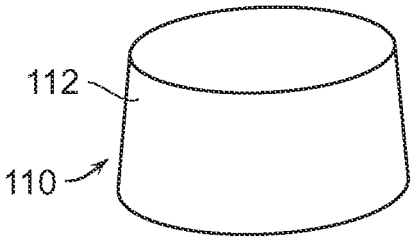
Figure 3Q:
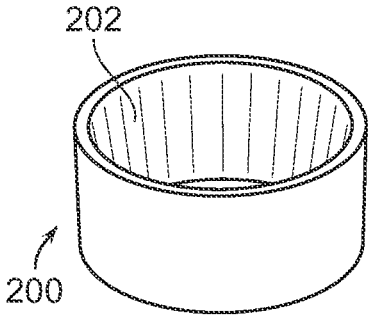
Figure 3R:
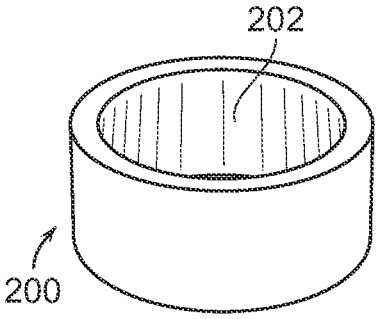

FIGS. 3*a*-3*r* show perspective views of various embodiments of the attachment means and corresponding interfacing means in accordance with the present disclosure.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete, and fully conveys the scope of the present disclosure to those skilled in the art. In fact, it will be apparent to those skilled in the art that various modifications and variations can be made in the present invention without departing from the scope or spirit of the invention.

DETAILED DESCRIPTION OF THE PREFERRED EMBODIMENTS

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Figure 1:
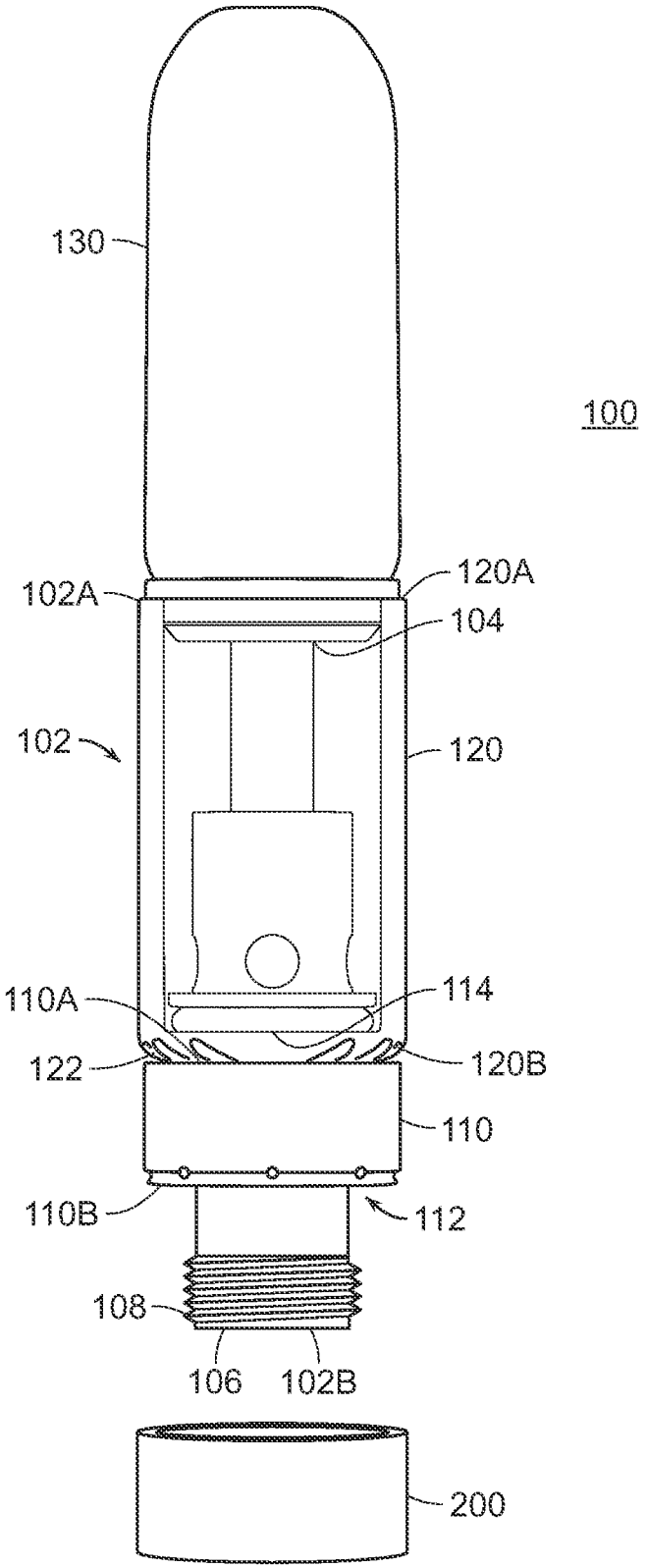
FIG. 1 is a front view showing an example embodiment of the vaporizer cartridge and first ring in accordance with the present disclosure.

Referring to FIG. 1, a front view of an embodiment of the vaporizer cartridge in accordance with the present disclosure is shown. Here the vaporizer cartridge 100 has a central member 102, a container 120, and a mouthpiece 130. The central member 102 has a top end 102A with a first opening 104 and a bottom end 102B with a second opening 106. Between the top end 102A and the bottom end 102B exists heating element 114. The central member 102 also includes a flared member 110, which has a top surface 110A and a bottom surface 110B. The flared member 110 is located between the top end 102A and the bottom end 102B. The container 120 extends from the top surface 110A to the top end 102A and envelops the heating element 114. Preferably the container 120 is constructed with a translucent or see-through material and has a flat top 120 and a tapered bottom 120B. The tapered bottom 120B forms a fluid-impermeable barrier 122 with the top surface 110A. The container 120 is configured to be able to hold and retain a liquid.

Beneath the flared member 110 is a threaded portion 108 which envelops the bottom opening 106. The flared member 110 is equipped with a first means for attachment 112, which is used to provide for the removable attachment of a first ring 200 to the vaporizer cartridge 100. When interfaced with the first attachment means 112, the first ring 200 leaves the threaded section 108 at least partially exposed such that the vaporizer cartridge 100 may interface with a battery (not pictured).

Figure 2:
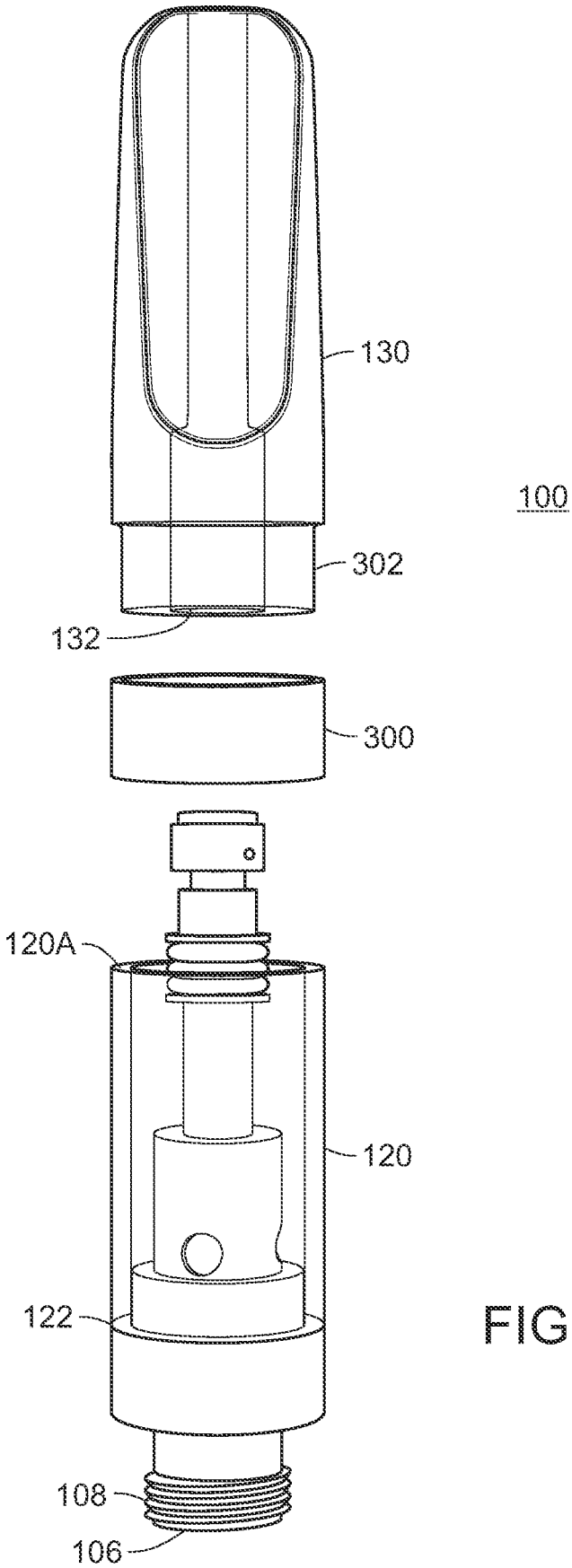
FIG. 2 is a front view, showing a second embodiment of the vaporizer cartridge and second ring in accordance with the present disclosure.

Referring to FIG. 2, an alternate embodiment of the vaporizer cartridge 100 is shown. Here, a second ring 300 is shown, but in every aspect the second ring 300 is interchangeable with the first ring 200. For the avoidance of doubt, any reference to any aspect or element of the first ring 200 is perfectly interchangeable with the second ring 300.

In this embodiment, the mouthpiece 130 features additional structural elements, namely a second means for attachment 302. Similarity to the first ring 200 and the second right 300, any reference to any aspect or element of the first means for attachment 112 is perfectly interchangeable with any aspect or element of the second means for attachment 302. Specifically, this embodiment of the vaporizer cartridge has the second ring 300 in between the flat top 120A and the mouthpiece 130. Also visible in this embodiment is a depression located on the mouthpiece 130.

Here, the mouthpiece 130 includes a fluid passthrough 132, which provides for the fluid communication between the bottom opening 106 and the mouthpiece 130. Also present in this embodiment is the fluid-impermeable barrier 122, although the container 120 in this embodiment does not have the tapered bottom 120B. Note in this embodiment, that as the mouthpiece 130 abuts against the flat top 120A another fluid impermeable barrier is formed. In various embodiments the container 120 will be filled with liquid during the assembly of the vaporizer cartridge 100. In other embodiments, the vaporizer cartridge 100 is easily disassembled such that the container 120 can be filled with liquid after the vaporizer cartridge 100 has been initially assembled.

FIGS. 3*a*-3*r* show various embodiments of the first attachment means 112 and second attachment means in accordance with the present disclosure. In these figures, a first interfacing means 202 is shown on the first ring, where the first attachment means 112 and the first interfacing 202 operate in a "male-female" relationship. That is, the first attachment means 112 often serves as a "male" attachment to a corresponding "female" interfacing element in the first interfacing means 202. In other embodiments, the first attachment means 112 often serves as a "female" attachment to a corresponding "male" interfacing element in the first interfacing means 202.

Moreover, in FIGS. 3*a*-3*r*, reference numbers for only the first attachment means 112 is shown, as the embodiments depicted therein show the first attachment means 112 on the flared member 110. However, the first attachment means 112 and the second attachment means in accordance with the present disclosure are perfectly interchangeable. That is, any attachment means utilized to provide for the removable attachment of the first ring 200 to the flared member 110 can also be used to provide for the removable attachment of the second ring to the mouthpiece, via the second attachment means.

In the below descriptions of FIGS. 3*a*-3*r*, any reference to the first attachment means 112 is interchangeable with the second attachment means, any reference to the flared member 110 is interchangeable for the mouthpiece, any reference to the first ring 200 is interchangeable with the second ring, and any reference to the first interfacing means 202 is interchangeable with the second interfacing means.

Further, embodiments exist where the vaporizer cartridge in accordance with the present disclosure is equipped with both a first ring 200, a first attachment means 112, a second ring, and a second attachment means, all while allowing the container 120 to hold and retain any liquid inserted therein.

FIG. 3*a* shows a first embodiment of the attachment means 112 where the attachment means 112 is a recessed portion on the bottom of the flared member 110 where the recess is concave in shape. Here, the first ring 200 has a first interfacing means 202 which is a convex protrusion, sized to create a releasable pressure-fit when the first ring 200 is disposed on the flared member 110.

FIG. 3*b* shows a second embodiment of the attachment means 112 where the attachment means 112 is a recessed portion on the top of the flared member 110 where the recess is also concave in shape. Here, the first ring 200 has a first interfacing means 202 which is also a convex protrusion, sized to create a releasable pressure-fit when the first ring 200 is disposed on the flared member 110.

FIG. 3*c* shows a third embodiment of the attachment means 112 where the attachment means 112 is a recessed portion on the middle of the flared member 110 where the recess is also concave in shape. Here, the first ring 200 has a first interfacing means 202 which is also a convex protrusion, sized to create a releasable pressure-fit when the first ring 200 is disposed on the flared member 110.

FIG. 3*d* shows a fourth embodiment of the attachment means 112 where the attachment means 112 is a recessed portion on the bottom of the flared member 110 where the recess is concave in shape, with a plurality of small bumps adding to the protrusion. Here, six bumps are shown atop the concave protrusion, but embodiments of different numbers of bumps are also contemplated. In this embodiment, the first ring 200 has a first interfacing means 202 which is a convex protrusion adorned with bumps that correspond to the bumps on the threaded member 110, sized to create a releasable pressure-fit when the first ring 200 is disposed on the flared member 110.

FIG. 3*e* shows a fifth embodiment of the attachment means 112 where the attachment means 112 is a recessed portion on the bottom of the flared member 110 where the recess is concave in shape, with a plurality of small channels adding to the protrusion. Here, eight channels are shown atop the concave protrusion, but embodiments of different numbers of channels are also contemplated. In this embodiment, the first ring 200 has a first interfacing means 202 which is a convex protrusion adorned with additional convex protrusions that correspond to the channels on the threaded member 110, sized to create a releasable pressure-fit when the first ring 200 is disposed on the flared member 110.

FIG. 3*f* shows a sixth embodiment of the attachment means 112, where the attachment means 112 are two recesses on opposite ends of the top of flared member 110. These recesses are preferably not of a uniform depth and have a substantially perpendicular portion to serve as a ledge. In this embodiment, the first interfacing means 202 of the ring 200 is a pair of clips sized to releasably hook into the recesses and press against each ledge of the attachment means 112.

FIG. 3*g* shows a seventh embodiment of the attachment means 112, where the attachment means 112 are two recesses on opposite ends of the bottom of flared member 110. These recesses are preferably not of a uniform depth and have a substantially perpendicular portion to serve as a ledge. In this embodiment, the first interfacing means 202 of the ring 200 is a pair of clips sized to releasably hook into the recesses and press against each ledge of the attachment means 112.

FIG. 3*h* shows an eight embodiment of the attachment means 112 where the attachment means 112 is a smooth wall. Here, the first ring 200 has a first interfacing means 202 which is a convex protrusion with a perpendicular slit going up a wall of the ring, enabling the ring to releasable snap onto the flared member 110.

FIG. 3*i* shows a ninth embodiment of the attachment means 112 where the attachment means 112 is three recessed portions, one on the top, one on the bottom, and one on the middle of the flared member 110 where the recesses are all concave in shape. Here, the first ring 200 has a first interfacing means 202 which is three convex protrusions, each sized to create a releasable pressure-fit when the first ring 200 is disposed on the flared member 110.

FIG. 3*j* shows a tenth embodiment of the attachment means 112 where the attachment means 112 is a standard thread running along the wall of the flared member 110. In this embodiment the ring 200 has the interfacing means 202 as threads corresponding to the threads of the flared member 110. The ring 200 attaches to the flared member 110 by being rotating against the flared member 110 until the threads engage.

FIG. 3*k* shows an eleventh embodiment of the attachment means 112 where the walls of the threaded member 110 are concave, creating this embodiment of the attachment means 112. In this embodiment, the ring 200 has convex walls with a curvature to match that of the flared member 110, which serves as the interfacing means 202 in this embodiment. To attach the ring 200 to the flared member 110, the ring is merely pushed onto the flared member 110 to create a releasable pressure fit between the two components.

FIG. 3*l* shows a twelfth embodiment of the attachment means 112 where the walls of the threaded member 110 are concave with a plurality of depressions in the middle of the flared member 110, creating this embodiment of the attachment means 112. In this embodiment, the ring 200 has convex walls with a curvature to match that of the flared member 110 the convex walls being adorned with a plurality of bumps that correspond to the plurality of depressions, which serves as the interfacing means 202 in this embodiment. To attach the ring 200 to the flared member 110, the ring is merely pushed onto the flared member 110 to create a releasable pressure fit between the two components. In this embodiment, six bumps are shown but any number of bumps/depressions are contemplated by this disclosure.

FIG. 3*m* shows a thirteenth embodiment of the attachment means 112 where the walls of the threaded member 110 are convex, creating this embodiment of the attachment means 112. In this embodiment, the ring 200 has concave walls with a curvature to match that of the flared member 110, which serves as the interfacing means 202 in this embodiment. To attach the ring 200 to the flared member 110, the ring is merely pushed onto the flared member 110 to create a releasable pressure fit between the two components.

FIG. 3*n* shows a fourteenth embodiment of the attachment means 112 where the walls of the threaded member 110 are convex with a plurality of depressions in the middle of the flared member 110, creating this embodiment of the attachment means 112. In this embodiment, the ring 200 has concave walls with a curvature to match that of the flared member 110 the concave walls being adorned with a plurality of bumps that correspond to the plurality of depressions, which serves as the interfacing means 202 in this embodiment. To attach the ring 200 to the flared member 110, the ring is merely pushed onto the flared member 110 to create a releasable pressure fit between the two components. In this embodiment, six bumps are shown but any number of bumps/protrusions are contemplated by this disclosure.

FIG. 3*o* shows a fifteenth embodiment of the attachment means 112 where the walls of the threaded member 110 are concave with a plurality of channels in the middle of the flared member 110, creating this embodiment of the attachment means 112. In this embodiment, the ring 200 has convex walls with a curvature to match that of the flared member 110 the convex walls being adorned with a plurality of additional protrusions that correspond to the number of channels, which serves as the interfacing means 202 in this embodiment. To attach the ring 200 to the flared member 110, the ring is merely pushed onto the flared member 110 to create a releasable pressure fit between the two components. In this embodiment, eight channels are shown but any number of channels/additional protrusions are contemplated by this disclosure.

FIG. 3*p* shows a sixteenth embodiment of the attachment means 112 where the walls of the threaded member 110 are convex with a plurality of channels in the middle of the flared member 110, creating this embodiment of the attachment means 112. In this embodiment, the ring 200 has concave walls with a curvature to match that of the flared member 110 the concave walls being adorned with a plurality of additional protrusions that correspond to the number of channels, which serves as the interfacing means 202 in this embodiment. To attach the ring 200 to the flared member 110, the ring is merely pushed onto the flared member 110 to create a releasable pressure fit between the two components. In this embodiment, eight channels are shown but any number of channels/additional protrusions are contemplated by this disclosure.

FIG. 3*q* shows a seventeenth embodiment of the attachment means 112 where the walls of the threaded member 110 are sloped inward, creating this embodiment of the attachment means 112. In this embodiment, the ring 200 has walls that are sloped outward, with a slope that corresponds to that of the flared member 110, which serves as the interfacing means 202 in this embodiment. To attach the ring 200 to the flared member 110, the ring is merely pushed onto the flared member 110 to create a releasable pressure fit between the two components.

FIG. 3*r* shows an eighteenth embodiment of the attachment means 112 where the walls of the threaded member 110 are sloped outward, creating this embodiment of the attachment means 112. In this embodiment, the ring 200 has walls that are sloped inward, with a slope that corresponds to that of the flared member 110, which serves as the interfacing means 202 in this embodiment. To attach the ring 200 to the flared member 110, the ring is merely pushed onto the flared member 110 to create a releasable pressure fit between the two components.

When introducing elements of the present disclosure or the embodiment(s) thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

While the disclosure refers to exemplary embodiments, it will be understood by those skilled in the art that various changes may be made and equivalents may be substituted for elements thereof without departing from the scope of the disclosure. In addition, many modifications will be appreciated by those skilled in the art to adapt a particular instrument, situation or material to the teachings of the disclosure without departing from the spirit thereof. Therefore, it is intended that the disclosure not be limited to the particular embodiments disclosed.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," and "third," are used herein to describe various elements, components, regions, layers and/or sections, these elements, components, regions, layers and/or sections should not be limited by these terms. These terms are only used to distinguish one element, component, region, layer and/or section from another element, component, region, layer and/or section. Thus, a "first element," "component," "region," "layer" and/or "section" discussed below could be termed a second element, component, region, layer and/or section without departing from the teachings herein.

Features illustrated or described as part of one embodiment can be used with another embodiment and such variations come within the scope of the appended claims and their equivalents.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

As the invention has been described in connection with what is presently considered to be the most practical and various embodiments, it is to be understood that the invention is not to be limited to the disclosed embodiments, but on the contrary, is intended to cover various modifications and equivalent arrangements included within the scope of the appended claims. Although specific terms are employed herein, they are used in a generic and descriptive sense only and not for purposes of limitation.

This written description uses examples to disclose the invention, including the best mode, and also to enable any person skilled in the art to practice the invention, including making and using any devices or systems and performing any incorporated methods. The patentable scope of the invention is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

In conclusion, herein is presented a vaporizer cartridge with a removable ring. The disclosure is illustrated by example in the drawing figures, and throughout the written description. It should be understood that numerous variations are possible while adhering to the inventive concept. Such variations are contemplated as being a part of the present disclosure.

What is claimed is:

1. A vaporizer cartridge, comprising:

a central member having a first end with a first opening, a second end with a second opening and a threaded section, and a flared member therebetween, wherein the flared member has a first surface, a second surface, and a first attachment means, wherein the central member contains a heating element, wherein the threaded section is beneath the flared member;

a container having a top and a bottom, the container being configured to couple with the first surface and extend towards the first end, wherein the container is sized to substantially contain the heating element, wherein the container creates a fluid-impermeable barrier with the first surface;

a mouthpiece disposed on the first end, the mouthpiece having a fluid passthrough which is in fluid communication with the first opening and the second opening; and a first ring sized to interface with and overlap with the flared member via the first attachment means, wherein the first ring is attached to the first attachment means, wherein the first ring does not overlap with the threaded section when interfaced with the first attachment means, and wherein the first ring comprises an ornamentation printed thereon.

2. The vaporizer cartridge of claim 1, wherein the top of the container is a flat top.

3. The vaporizer cartridge of claim 1, the container further comprising a tapered bottom.

4. A vaporizer cartridge, comprising:

a central member having a first end with a first opening, a second end with a second opening and a threaded section, and a flared member therebetween, wherein the flared member has a first surface and a second surface, wherein the central member contains a heating element, wherein the threaded section is proximate to the flared member;

a container having a top and a bottom, the container being configured to couple with the first surface and extend towards the first end, wherein the container is sized to substantially contain the heating element, wherein the container creates a fluid-impermeable barrier with the first surface;

a mouthpiece disposed on the first end, the mouthpiece having a fluid passthrough which is in fluid communication with the first opening and the second opening; and a first ring sized to interface with the top and abut against the mouthpiece.

5. The vaporizer cartridge of claim 4, wherein the top of the container is a flat top.

6. The vaporizer cartridge of claim 4, the container further comprising a tapered bottom.

7. The vaporizer cartridge of claim 4, further comprising a second ring sized to interface with and overlap with the flared member, wherein the flared member comprises a first attachment means on the second surface, wherein the second ring is removably attached to the first attachment means, and wherein the first ring does not overlap with the threaded section when interfaced with the first attachment means.

* * * * *